US008148313B2

(12) United States Patent
Alexandre et al.

(10) Patent No.: US 8,148,313 B2
(45) Date of Patent: Apr. 3, 2012

(54) USE OF A MIXTURE OF NON-IONIC SURFACTANTS IN CLEANSING COMPOSITIONS

(75) Inventors: Teresa Alexandre, Düsseldorf (DE); Hans-Christian Raths, Monheim (DE); Manfred Weuthen, Langenfeld (DE); Sabine Both, Neuss (DE)

(73) Assignee: Cognis IP Management GmbH, Duesseldorf (DE)

( * ) Notice: Subject to any disclaimer, the term of this patent is extended or adjusted under 35 U.S.C. 154(b) by 56 days.

(21) Appl. No.: 12/867,010

(22) PCT Filed: Feb. 6, 2009

(86) PCT No.: PCT/EP2009/000823

§ 371 (c)(1),
(2), (4) Date: Aug. 10, 2010

(87) PCT Pub. No.: WO2009/100855

PCT Pub. Date: Aug. 20, 2009

(65) Prior Publication Data

US 2010/0323948 A1 Dec. 23, 2010

(30) Foreign Application Priority Data

Feb. 14, 2008 (DE) ..... 10 2008 009 366

(51) Int. Cl.
*C11D 1/825* (2006.01)

(52) U.S. Cl. ..... 510/220; 510/221; 510/421; 510/422; 510/524

(58) Field of Classification Search ..... 510/220, 510/221, 421, 422, 524
See application file for complete search history.

(56) References Cited

U.S. PATENT DOCUMENTS

| | | | | |
|---|---|---|---|---|
| 5,880,089 | A | 3/1999 | Lentsch et al. | |
| 2005/0143280 | A1 | 6/2005 | Nelson et al. | |
| 2008/0139438 | A1 * | 6/2008 | Boehme et al. | 510/221 |

FOREIGN PATENT DOCUMENTS

| | | | |
|---|---|---|---|
| DE | 19738866 | | 3/1999 |
| DE | 19738866 | A1 | 3/1999 |
| DE | 10045289 | | 3/2002 |
| EP | 1254947 | A1 | 11/2002 |
| EP | 1254948 | | 11/2002 |
| EP | 1254948 | A1 | 11/2002 |
| EP | 1288281 | | 3/2003 |
| EP | 1288281 | A2 | 3/2003 |
| EP | 1306423 | | 5/2003 |
| EP | 1321511 | | 6/2003 |
| EP | 1321511 | A2 | 6/2003 |
| EP | 1764408 | | 3/2007 |
| WO | 95/13260 | | 5/1995 |
| WO | WO-95/13260 | | 5/1995 |
| WO | 96/00253 | | 1/1996 |
| WO | WO-96/00253 | | 1/1996 |

OTHER PUBLICATIONS

European Search Report in EP 10 18 7277, date mailed Mar. 24, 2011, 5 pgs.

* cited by examiner

*Primary Examiner* — Charles Boyer
(74) *Attorney, Agent, or Firm* — Diehl Servilla LLC

(57) ABSTRACT

The invention relates to selected surface-active substances of groups a) and b), the surface-active compound a) being selected from compounds of general formula (Ia), wherein M represents a group $CH_2$—$CH_2$ or CHR—$CH_2$, R, R' or R" independently represent saturated, unsaturated, linear or branched alkyl groups or alkenyl groups with 6 to 22 C atoms, and the indices n and m independently can have values between 1 and 40, and/or compounds of general formula (Ib), wherein R''' and R'''' independently represent saturated, unsaturated, linear or branched alkyl groups or alkenyl groups with 4 to 22 C atoms, and the indices n and m independently can have values between 1 and 40 and X' and X" independently represent H or saturated, unsaturated, linear or branched alkyl groups or alkenyl groups with 1 to 18 C atoms. The surface active substances of the invention, either on their own or combined with other nonionic surfactants, lead to dishwashing agents with an improved drying performance, especially in multifunctional agents for automatic dishwashers.

(Ia)

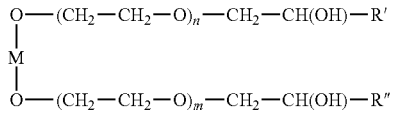

(Ib)

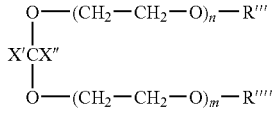

17 Claims, No Drawings

USE OF A MIXTURE OF NON-IONIC SURFACTANTS IN CLEANSING COMPOSITIONS

BACKGROUND OF THE INVENTION

The present invention relates to the use of selected surface-active substances, alone or in combination, for use in cleaning agents and in particular in dishwashing agents for automatic dishwashing.

The cleaning of hard surfaces and in particular the washing of dishes places particular requirements on the cleaners used. This is true especially for machine dishwashing. The three components of the machine system are cleaner, rinse aid and regenerating salt for softening the water. Here, the central tasks of the cleaner main constituent are soil release, soil dispersion, the binding of residual water hardness and corrosion inhibition. An important parameter for dishwashing is the clear-rinse performance. Here, it is ascertained how large the fraction of deposits on the ware parts is after these have been rinsed. The deposits are essentially mineral compounds, in particular Ca and/or Mg salts, but also surfactant residues. Primarily, however, lime leads to the deposits undesired for the user. In order to reduce the fraction of these deposits, customary dishwashing agents, especially those for automatic dishwashing, generally comprise so-called rinse aids. Standard commercial rinse aids are usually mixtures of weakly foaming nonionic surfactants, typically fatty alcohol polyethylene/polypropylene glycol ethers, solubility promoters (e.g. cumene sulfonate), organic acids (e.g. citric acid) and solvents (e.g. ethanol). The aim of these agents is to influence the interfacial tension of the water in such a way that it can run off the ware in the thinnest possible coherent film such that no water drops, streaks or films are left behind during the subsequent drying operation. A distinction is made between two types of deposits. Firstly, the so-called "spotting" is investigated, which arises as a result of drying water drops, and secondly "filming" is evaluated, i.e. layers which are formed by the drying of thin water films. For the evaluation, test persons are currently used who visually evaluate the parameters of "spotting" and "filming" on cleaned objects, e.g. plates, glasses, knives etc. Modern cleaning agents for dishwashing therefore comprise rinse aids in order to improve the run-off of water from the surfaces of the ware. There are rinse aids which do not dry equally as well on all substrates, such as e.g. plastic. In order to avoid this effect, complex classic rinse aids are formulated, which have e.g. silicone compounds and/or fluorinated compounds, as are described in U.S. Pat. No. 5,880,089 or US 2005/0143280 A1. However, these compounds are biodegradable with difficulty, if at all, and some are even hazardous to the environment.

More recently, combination products have increasingly been used; these combine the different functions, such as cleaning, clear rinsing, water softening and optionally metal protection, in particular silver protection, or a glass protection functions in a, preferably solid, supply form. Such agents are referred to as multifunctional agents. Thus, for example so-called 3-in-1 products which combine cleaner, rinse aid and water softener in the form of a solid compact ("tab") are found on the market. As a result of the increased use of such multifunctional agents, however, the drying performance has become worse compared to using a classic rinse aid. Drying performance is to be understood here as meaning to what extent the cleaned ware still has water, preferably water drops, on the surface after passing through the dishwashing process. The water remaining on the surface then has to either be removed mechanically (e.g. by wiping dry) or the ware has to be left to dry in the air. The user thus has to wait until the water has evaporated. In this connection, however, residues (e.g. lime and/or surfactant residues or other residues which were dissolved or dispersed in the water) remain on the surface and lead to unesthetic marks or streaks. This is true to a particular extent on shiny or transparent surface, such as e.g. glass or metal. For this reason, ways have been sought to improve the drying performance of cleaning agents for hard surfaces, in particular of dishwashing agents. EP 1 306 423 A2 discloses aqueous cleaning agents which comprise alkyl ether sulfates and amphoteric glycine compounds and are suitable for improving the drying behavior of dishwashing agents. DE 100 45 289 A1 describes hand dishwashing agents which comprise certain quaternary ammonium compounds and alkyl ether sulfates alongside one another and likewise exhibit particularly good drying behavior.

Furthermore, additives for cleaning agents must not adversely affect the washing performance, and in particular the clear-rinse performance, of the cleaners. In an ideal case, an addition should even improve the performance of the cleaner overall.

SUMMARY OF THE INVENTION

It has now been found that the combination of certain surface-active substances is suitable for improving the drying performance of cleaning agents for hard surfaces, in particular of agents for dishwashing, and here very particularly in multifunctional agents, and at the same time being ecologically acceptable.

The present invention therefore provides, in a first embodiment, mixtures comprising at least two different surface-active substances from the groups a) and b), where the surface-active compound a) is selected from compounds which follow the general formula (Ia):

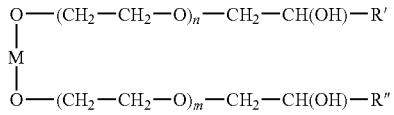

(Ia)

in which M is a radical $CH_2$—$CH_2$ or CHR—$CH_2$, R, R' and R", independently of one another, are saturated, unsaturated, linear or branched alkyl or alkenyl radicals having 6 to 22 carbon atoms, and the indices n and m, independently of one another, can assume values between 1 and 40, and/or follow compounds of the general formula (Ib)

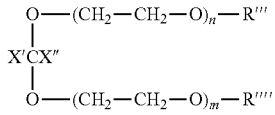

(Ib)

in which R''' and R'''', independently of one another, are saturated, unsaturated, linear or branched alkyl or alkenyl radicals having 4 to 22 carbon atoms, and the indices n and m, independently of one another, can assume values between 1 and 40, X' and X", independently of one another, are H or saturated, unsaturated, linear or branched alkyl or alkenyl radicals having 1 to 18 carbon atoms the component b) is selected from b1) compounds of the general formula (II)

$$R^1O[CH_2CH_2O]_xCH_2CH(OM)R^2 \quad (II)$$

in which $R^1$ is a linear or branched alkyl and/or alkenyl radical having 4 to 22 carbon atoms, or is a radical $R^2$—CH(OH)$CH_2$, where $R^2$ is a linear or branched alkyl and/or alkenyl radical having 8 to 16 carbon atoms, x is a number from 20 to 80, preferably from 40 to 80, and M is a hydrogen atom or a saturated alkyl radical having 1 to 18 carbon atoms, and/or from compounds of group b2) according to the general formula III $$R^3O[CH_2CH_2O]_y[CH_2CHCH_3O]_zCH_2CH(OH)R^4 \quad (III)$$

in which $R^3$ is a linear or branched alkyl and/or alkenyl radical having 8 to 22 carbon atoms, $R^4$ is a linear or branched alkyl and/or alkenyl radical having 8 to 16 carbon atoms, y is a number from 10 and 35, z is zero or a number from 1 to 5, with the proviso that when $R^3$=$R^1$ and simultaneously $R^4$=$R^2$, that then z must be at least 1.

EP 1 645 618 A1 by the applicant already discloses mixtures of hydroxy mixed ethers according to the formulae (II) and (III) with polyol hydroxyalkyl ethers and use thereof in dishwashing agents. However, these mixtures relate to different components of type a) compared to the present application. The described mixtures comprise at least one component selected from compounds of the formulae (Ia) or (Ib), and at least one compounds selected from compounds of the formulae (II) or (III). The compounds of the formulae (Ia), (Ib), (II) and (III) are chemical compounds known to the person skilled in the art.

DESCRIPTION OF THE PREFERRED EMBODIMENTS

Compounds of Group a)

The mixtures according to the invention obligatorily comprise compounds of type a). These are compounds of the above formulae (Ia) and/or (Ib), where certain structures are preferred. Preference is given in particular to compounds according to the general formula (Ia), when M is a $CH_2$—CRH group, R is a linear, saturated alkyl radical having 8 to 16, preferably 8 to 12 and in particular 8 to 10 carbon atoms, and R' and R" is in each case independently of the other a linear, saturated alkyl radical having 10 to 16, preferably 10 to 14 carbon atoms, and n and m, independently of one another, can have values from 20 to 30. Such compounds can be obtained for example by reacting alkyldiols, HO—CHR—$CH_2$—OH, with ethylene oxide, in which case a reaction with an alkyl epoxide subsequently takes place to close the free OH functions, resulting in a dihydroxy ether.

Preference is likewise given to structures which follow the general formula (Ib):

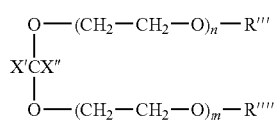

(Ib)

where X' and X"=H, and in the formula (Ib) the indices n and m, independently of one another, can assume values from 1 to 40, but preferably from 1 to 15. Particular preference is given here to compounds of the formula (Ib) in which the radicals R''' or R'''', independently of one another, are saturated alkyl radical having 4 to 14 carbon atoms, and the indices n and m, independently of one another, assume values from 1 to 15 and in particular from 1 to 12. Further preference is given to those compounds of the formula (Ib) in which a radical R''' or R'''' is branched. Independently of this, compounds of the formula (Ib) in which the indices n and m are even-numbered and have values in the range from 8 to 12 are preferred.

The second component of the mixtures are compounds of the formulae (II) or (III), which can be referred to as hydroxy mixed ethers.

Hydroxy Mixed Ethers

Hydroxy mixed ethers (abbreviated hereinbelow as HME) follow the broad general formula $$R'O[AO]_xCH_2CH(OM)R''$$

in which R' is a linear or branched alkyl and/or alkenyl radical having 4 to 22 carbon atoms, R" is a linear or branched alkyl and/or alkenyl radical having 2 to 22 carbon atoms, x is 10 to 80, and AO symbolizes an ethylene oxide, propylene oxide and/or butylene oxide radical, and M may be a hydrogen atom or an alkyl or alkenyl radical.

Such hydroxy mixed ethers are known in the literature and are described for example in the German application DE 19738866. They are prepared for example by reacting 1,2-epoxyalkanes (R"$CHOCH_2$), where R" is an alkyl and/or alkenyl radical having 2 to 22, in particular 6 to 16, carbon atoms, with alkoxylated alcohols.

Within the context of the invention, preference is given to those hydroxy mixed ethers which are derived from alkoxylates of monohydric alcohols of the formula R'—OH having 4 to 18 carbon atoms, where R' is an aliphatic, saturated, straight-chain or branched alkyl radical, in particular having 6 to 16 carbon atoms. Examples of suitable straight-chain alcohols are butanol-1, caproic, oenanthic, caprylic, pelargonic, capric alcohol, undecanol-1, lauryl alcohol, tridecanol-1, myristyl alcohol, pentadecanol-1, palmityl alcohol, heptadecanol-1, stearyl alcohol, nonadecanol-1, arachidyl alcohol, heneicosanol-1, behenyl alcohol, and technical-grade mixtures thereof, as are produced in the high-pressure hydrogenation of technical-grade methyl esters based on fats and oils. Examples of branched alcohols are so-called oxo alcohols, which mostly carry 2 to 4 methyl groups as branches and are prepared by the oxo process, and so-called Guerbet alcohols, which are branched in the 2-position with an alkyl group. Suitable Guerbet alcohols are 2-ethylhexanol, 2-butyloctanol, 2-hexyldecanol and/or 2-octyldodecanol. The alcohols are used in the form of their alkoxylates, which are prepared by reacting the alcohols with ethylene oxide in a known manner.

Surface-Active Compounds of Type b1)

These are standard commercial surfactants of the general formula (II)

$$R^1O[CH_2CH_2O]_xCH_2CH(OM)R^2 \quad (II)$$

in which $R^1$ is a linear or branched alkyl and/or alkenyl radical having 4 to 22 carbon atoms, or is a radical $R^2$—CH(OH)$CH_2$, where $R^2$ is a linear or branched alkyl and/or alkenyl radical having 8 to 16 carbon atoms, x is a number from 40 to 80, and M is a hydrogen atom or a saturated alkyl radical having 1 to 18 carbon atoms. Advantageously, those compounds of type b) of the general formula (II) are used which contain at least one free hydroxyl group (=—OH). Within the context of the invention, preference is given to those hydroxy mixed ethers which are derived from ethoxylates of monohydric alcohols of the formula $R^1$—OH having 6 to 18 carbon atoms, preferably 6 to 16 and in particular 8 to 10 carbon atoms, where $R^1$ is a linear alkyl radical and x is 40 to 60. Furthermore, in the mixtures according to the invention, preference is given to those compounds of the general formula (II)

in which the index x is a number from 40 to 70, preferably 40 to 60 and in particular from 40 to 50. M is here then a hydrogen atom. Very particular preference is given to hydroxy mixed ethers of the formula (II), where $R^1$ is an alkyl radical having 8 to 10 carbon atoms, in particular based on a native fatty alcohol, $R^2$ is an alkyl radical having 10 carbon atoms, in particular a linear alkyl radical and x is 40 to 60. Preference is also given to mixtures which comprises, as surface-active compound of type a), a compound according to the general formula (II) in which $R^1$ is an alkyl and/or alkenyl radical having 8 to 10 carbon atoms and $R^2$ is an alkyl or alkenyl radical having 8 to 10 carbon atoms and x is a number from 40 to 50, where, here too, M is a hydrogen atom.

A particularly preferred HME within the context of the present teaching follows the general formula

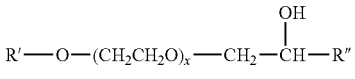

where R' is a saturated alkyl radical having 8 to 12, preferably 8 to 10, carbon atoms, and R" is an alkyl radical having 8 to 12, preferably 8 to 10, carbon atoms. The index x can have values from 20 to 80, preferably from 30 to 60 and in particular from 40 to 50, where in general preference is given to those compounds in which the index x is greater than 40.

Surface-Active Compounds of Type b2)

These compounds are likewise HME, although these have a different structure than the HME of the general formula (II).

The compounds of type b2) follow the formula (III)

$$R^3O[CH_2CHCH_3O]_z[CH_2CH_2O]_yCH_2CH(OH)R^4 \quad (III)$$

in which $R^3$ is a linear or branched alkyl and/or alkenyl radical having 8 to 22 carbon atoms, $R^4$ is a linear or branched alkyl and/or alkenyl radical having 8 to 16 carbon atoms, y is a number from 10 and 35, z is zero or must be a number from 1 to 5. It may be advantageous that, if $R^3=R^1$ and simultaneously $R^4=R^2$, those compounds of the formula b2) are selected in which the index z is at least 1. If mixtures of the surface-active compounds of type a) with those of type b2) are used, only those mixtures in which the molecules are structurally different from one another are within the context of the present technical teaching. Consequently, structurally different compounds must always be present alongside one another. Particularly preferred compounds of type b2) are, for example, those in which, in the formula (III), the index y is a number from 20 to 30, preferably from 20 to 25. Furthermore, preference is given to those compounds of type b2) in which, in the formula (III), $R^3$ represents an alkyl radical having 8 to 12, preferably 8 to 10, carbon atoms, $R^4$ is an alkyl radical having 10 to 12, preferably having 10 carbon atoms, y is a number from 15 to 35, preferably 20 to 30, and z is a number from 1 to 3, preferably 1. Preference is also given to mixtures which comprise, as surface-active compound of type b2), a compound according to the general formula (III) in which $R^3$ is an alkyl and/or alkenyl radical having 9 to 18 carbon atoms, and $R^4$ is an alkyl or alkenyl radical having 8 to 10 carbon atoms and y is a number from 20 to 35.

Preference is likewise given to mixtures which comprises, as surface-active compound of type b2), a compound according to the general formula (III) in which $R^3$ is an alkyl and/or alkenyl radical having 8 to 12 carbon atoms, and $R^4$ is an alkyl or alkenyl radical having 8 to 10 carbon atoms, and y is a number from 20 to 35 and z is a number from 1 to 3. The compounds of type b2) are likewise hydroxy mixed ether derivatives which can be prepared by reacting propoxylated and/or ethoxylated fatty alcohols with alkyl epoxides by ring-opening in an alkaline medium.

In this connection, in the case of derivatives of type b2), as also in the case of all other mixed alkoxylates listed in this description which comprise both a propylene oxide radical $CH_2CHCH_3O$(PO) and also an ethylene oxide radical $CH_2CH_2O$(EO), it is possible that from the direction of the carbon atom with the free hydroxyl group, firstly the EO radicals and then the PO radicals are arranged blockwise, where also the sequence first PO, then EO is possible. Furthermore, the alkoxide groups can also be present in the molecule in randomly distributed (randomized) form. It is also possible to use both block alkoxylates and also random alkoxylates alongside one another.

As far as the number of EO or PO groups in a molecule according to the formula of the present application is concerned, the values are average values since differently alkoxylated derivatives are present alongside one another as a result of the preparation. The number of alkyoxide groups can therefore also be odd-numbered.

A particularly preferred type of HME of the general formula (III) is described by the following Markush formula:

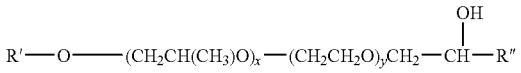

where R' and R", independently of one another, are a saturated alkyl radical having 8 to 12, preferably 8 to 10, carbon atoms. The index x can have values from 1 to 10, preferably from 1 to 4 and in particular from 1 to 2, and y has values from 10 to 30, preferably from 15 to 25 and in particular from 20 to 22, where in general preference is given to those compounds in which the index x=1.

The present invention now makes use of the finding that the presence of selected HME (type b)), or of derivatives thereof, in combination with structurally different surface-active compounds of type a) can have advantageous properties with regard to the drying performance and/or the clear-rinse performance of cleaner formulations for hard surfaces and in particular of dishwashing agents.

Particularly preferred mixtures within the context of the present technical teaching relate to combinations of the compounds according to the formulae (Ia) and/or (Ib) with compounds according to the formula (III).

Besides the above-described surface-active compounds, it may be advantageous to co-use further surface-active compounds (i.e. surfactants). Of suitability here are in particular pure fatty alcohols.

Fatty alcohols are to be understood as meaning primary aliphatic alcohols of the formula R—OH, in which R is an aliphatic, linear or branched hydrocarbon radical having 6 to 22 carbon atoms and 0 and/or 1, 2 or 3 double bonds. Typical examples are caproic alcohol, caprylic alcohol, 2-ethylhexyl alcohol, capric alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachyl alcohol, gadoleyl alcohol, behenyl alcohol, erucyl alcohol and brassidyl alcohol, and also technical-grade mixtures thereof which are produced e.g. during the high-pressure hydrogenation of technical-grade methyl esters based on fats and oils or aldehydes from the Roelen oxo synthesis, and also as monomer fraction during the dimerization of unsaturated fatty alcohols. Preference is given to technical-grade fatty alcohols having 12 to 18 carbon atoms, such as, for example, coconut, palm, palm kernel or tallow fatty alcohols.

The compounds of type a) and b) are preferably present in a weight ratio of from 10:1 to 1:10 alongside one another in the mixtures within the context of the invention. However, preference here may be given to those mixtures in which the surface-active compounds of type a) and b) are present in the weight ratio of from 5:1 to 1:5, in particular of from 3:1 to 1:3 and particularly preferably of from 2:1 to 1:2 and very particularly preferably of 1:1 alongside one another. The compounds of type b1) and/or b2) can—as already explained above—also be present alongside one another in any desired mixtures. Preferably, however, the mixtures consist only of one compound of type a) and one compound of type b).

The mixtures described above are preferably suitable for use in cleaning agents, in particular in dishwashing agents and in particular in agents for automatic dishwashing. The mixtures can be used for improving the drying performance of cleaning agents and in particular for dishwashing agents, preferably for dishwashing agents for machine dishwashing. A further preferred use relates to the use of the mixtures in multifunctional solid dishwashing agents for automatic dishwashing. The improvement in drying refers in particular to surfaces made of plastic.

In a further embodiment, agents are claimed which comprise 0.1 to 15% by weight of the mixtures according to the invention, and also further ingredients customary in cleaning agents and preferably dishwashing agents. Preferably, the cleaning agents comprise the mixtures according to the invention in amounts of from 0.1 to 12% by weight, where advantageously 1 to 10% by weight and in particular amounts of from 1.0 to 8% by weight are present. Particular preference is given to the range from 2.0 to 8.0% by weight.

The customary ingredients of the agents according to the invention within the context of the above description may be for example further nonionic, anionic and/or cationic surfactants, builders, enzymes, bleaches, such as e.g. percarbonates. Furthermore, such agents can comprise silicates, phosphorus compounds, carbonates, but also specific rinse aids and other known and customary auxiliaries and additives, e.g. pH regulators or enzymes. Moreover, solvents, such as water or lower aliphatic alcohols, preferably ethanol or propanol, solubilizers, polymers or organic acids, preferably citric acid and derivatives thereof.

The cleaning agents may either be liquid or solid, for example in the form of granules, powders or tablets. Liquid cleaning agents can also comprise viscosity formers in order to obtain e.g. gel-like agents.

Preferably, cleaning agents for machine dishwashing are present in solid form, thus e.g. as powders or granules or as moldings, preferably in tablet form. In this connection, it is also possible for two or more phases to be present alongside one another, for example a compacted tablet which comprises, in an indentation, a noncompacted part, e.g. a wax-like rinse aid phase. Such multifunctional agents are marketed as 2-in-1 or else 3-in-1 products. The preparation takes place in any manner known to the person skilled in the art, where, in one preferred embodiment, the mixtures according to the invention are present as compound and are preferably mixed with the other ingredients in any desired order. However, it is also possible to mix the surfactants of type a) and b) individually with the other ingredients and, for example, then to compact or to granulate this mixture to give the finished agent.

The present application further provides the use of compounds of the general formulae (Ia) and/or (Ib) without the aforementioned HME in cleaning agents, preferably dishwashing agents and particularly preferably in dishwashing agents for automatic dishwashing. The compounds according to the formulae (Ia) and/or (Ib) can also develop advantageous effect in a cleaning agent without co-use of the HME referred to above, here in particular with regard to improved drying behavior of the washed articles, and preferably those articles which have plastic surfaces or consist of plastics.

EXAMPLES

Preparation of the Surface-Active Compounds

Processes for the preparation of the surface-active compounds of the invention according to the general formulae (Ia) or (Ib) are described below:

1. Preparation of an Ether According to Formula (Ia):

Ethoxylate precursor: 1 mol of 1,2-dodecanediol and 0.06 mol of KOH as 45% strength solution are introduced as initial charge in a stirred autoclave under nitrogen. The system is then evacuated for 30 min at 120° C. The vacuum is then increased with nitrogen and the system is heated to 160-180° C. At 160° C., the addition of 40 mol of ethylene oxide starts at a maximum pressure of 5 bar. When the reaction has finished, the system is cooled to 120° C. and evacuated for 30 min. For subsequent storage, the product is neutralized (preferably with lactic acid or acetic acid) after cooling. For further reaction, neutralization is not carried out. The precursor is admixed under nitrogen with a further 0.05 mol of KOH and heated to 160-180° C. 2 mol of 1,2-epoxyhexadecane are then added dropwise over the course of 1 hour and the mixture is then stirred for 2 hours at 180° C. The system is then cooled also 60° C. and neutralized (preferably with lactic acid or acetic acid).

2. Preparation of an Acetal According to (Ib):

Fatty alcohol ethoxylate precursor: 1 mol of decanol and 0.03 mol of KOH as 45% strength solution are introduced as initial charge in a stirred autoclave under nitrogen. The system is then evacuated for 30 min at 120° C. The vacuum is then increased with nitrogen and the system is heated to 160-180° C. At 160° C., the addition of 9 mol of ethylene oxide starts at a maximum pressure of 5 bar. When the reaction is complete, the system is cooled to 120° C. and evacuated for 30 min. For subsequent storage or further use, the product is neutralized (preferably with lactic acid or acetic acid) after cooling.

3. Preparation of an Asymmetric Acetal According to (Ib):

The fatty alcohol ethoxylate prepared accordingly under 1. is reacted with excess dibutyl glycol formal in the presence of an acidic catalyst, preferably methanesulfonic acid. For this, fatty alcohol ethoxylate and dibutyl glycol formal are introduced as initial charge in the molar ratio of ca. 1.1 mol:1.7 mol and increased with 6 g of methanesulfonic acid slowly to 180° C. at a pressure of ca. 5 mbar. At a vapor temperature of ca. 121-137° C., butyl glycol and excess formal distils off. The product is then cooled to 50-70° C. and neutralized by adding NaOH.

4. Preparation of a Symmetrical Acetal According to (Ib):

1 mol of fatty alcohol ethoxylate according to 3) and 0.5 mol of dibutyl glycol formal are introduced as initial charge under nitrogen and admixed with 0.02 mol of sulfuric acid. At a bottom temperature of 97-152° C. and 5 mbar, butyl glycol and remains of the formal are distilled off. The mixture is then neutralized with NaOH or another base.

Application-Related Investigations

Three mixtures (1:1 w/w) of compounds according to the general formulae (Ia) and (Ib) with a propoxylated hydroxy mixed ether according to the general formula (III) were prepared. The surfactants of group a) used were: C10-alkyldiol 40 EO di-2-hydroxyhexadecyl ether for mixture A; butyl glycol isotridecyl alcohol 9EO-formal for mixture B; di-C8/C10-alkyl-11 EO-formal for mixture C. The hydroxy mixed ether of type b2) used in each case was a C8/C10-alkyl 1EO 22EO hydroxy-C10-alkyl ether.

These 1:1 mixtures A to C according to the invention were incorporated (to 8% by weight, based on the dishwashing agent) into a standard commercial formulation for a solid agent for automatic dishwashing. Assessment of the drying performance takes place by counting the drops still adhering to the ware after the washing process. For this, glasses, cutlery, plastic plates and also ceramic plates are washed under defined conditions (water with German hardness 21°, 50 g standard soiling) in a domestic dishwasher. When the wash program has finished, the ware is assessed for drop number under defined light conditions.

The results were attained by comparing the water drops remaining on a plastic surface after passing through the wash process. The standard formulation is composed of 2% by weight of a C8/C10-alkyl 1EO 22EO hydroxy-C10-alkyl ether, 1% by weight of a polymer, 7% by weight of sodium silicate, 52% by weight of sodium triphosphate, 2.5% by weight of TAED, 27.5% by weight of sodium carbonate and 8% by weight of sodium percarbonate.

Compared to the standard, the agents which comprised the mixtures A to C exhibited a reduction in the number of drops on plastic by 1 to 3.

The invention claimed is:

1. A mixture comprising at least two different surface-active substances from the groups a) and b), where the surface-active compound a) is selected from compounds of the general formula (Ia)

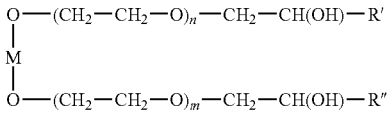

(Ia)

in which M is a radical $CH_2$—$CH_2$ or CHR—$CH_2$, R, R' and R", independently of one another, are saturated, unsaturated, linear or branched alkyl or alkenyl radicals having 6 to 22 carbon atoms, and the indices n and m, independently of one another, can assume values between 1 and 40, and/or compounds of the general formula (Ib)

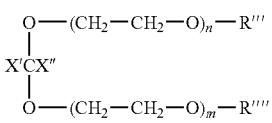

(Ib)

in which R''' and R'''', independently of one another, are saturated, unsaturated, linear or branched alkyl or alkenyl radicals having 4 to 22 carbon atoms, and the indices n and m, independently of one another, can assume values between 1 and 40, X' and X", independently of one another, are H or saturated, unsaturated, linear or branched alkyl or alkenyl radicals having 1 to 18 carbon atoms and the compounds of type b) of the general formula (II)

$$R^1O[CH_2CH_2O]_xCH_2CH(OM)R^2 \quad (II)$$

in which $R^1$ is a linear or branched alkyl and/or alkenyl radical having 4 to 22 carbon atoms, or is a radical $R^2$—$CH(OH)CH_2$, where $R^2$ is a linear or branched alkyl and/or alkenyl radical having 8 to 16 carbon atoms, x is a number from 20 to 80, preferably from 40 to 80, and M is a hydrogen atom or a saturated alkyl radical having 1 to 18 carbon atoms and/or of the general formula (III)

$$R^3O[CH_2CHCH_3O]_z[CH_2CH_2O]_yCH_2CH(OH)R^4 \quad (III)$$

in which $R^3$ is a linear or branched alkyl and/or alkenyl radical having 8 to 22 carbon atoms, $R^4$ is a linear or branched alkyl and/or alkenyl radical having 8 to 16 carbon atoms, y is a number from 10 and 35, z is zero or must be a number from 1 to 5.

2. The mixture as claimed in claim 1, wherein it comprises only one surface-active compound a) in combination with only one surface-active compound b).

3. The mixture as claimed in claim 1, wherein, in the formula (Ia), R, R' and R" are in each case a linear, saturated alkyl radical, where R is an alkyl radical having 8 to 16, R' and R", independently of one another, are an alkyl radical having 10 to 16 carbon atoms and n and m, independently of one another, assume a value from 20 to 30.

4. The mixture as claimed in claim 1, wherein, in the formula (Ib), the radicals R''' and R'''', independently of one another, are saturated alkyl radical having 4 to 14 carbon atoms, and the indices n and m, independently of one another, assume values from 1 to 15 and in particular from 1 to 12.

5. The mixture as claimed in claim 1, wherein, in the formula (II), the index x is a number from 40 to 70, preferably 40 to 60 and in particular from 40 to 50.

6. The mixture as claimed in claim 1, wherein, in the formula (III), the index y is a number from 20 to 30, preferably from 20 to 25.

7. The mixture as claimed in claim 1, wherein the surface-active compounds of type a) and b) are present alongside one another in the weight ratio of from 5:1 to 1:5, in particular of from 3:1 to 1:3 and particularly preferably of 1:1.

8. The mixture as claimed in claim 1, wherein it comprises, as surface-active compound of type b1), a compound according to the general formula (II) in which $R^1$ is an alkyl and/or alkenyl radical having 8 to 10 carbon atoms and $R^2$ is an alkyl or alkenyl radical having 8 to 10 carbon atoms and x is a number from 40 to 50.

9. The mixture as claimed in claim 1, wherein it comprises, as surface-active compound of type b2), a compound according to the general formula (III) in which $R^3$ is an alkyl and/or alkenyl radical having 11 to 18 carbon atoms and $R^4$ is an alkyl or alkenyl radical having 8 to 10 carbon atoms and y is a number from 20 to 35.

10. The mixture as claimed in claim 1, wherein it comprises, as surface-active compound of type b2), a compound according to the general formula (III) in which $R^3$ is an alkyl and/or alkenyl radical having 8 to 12 carbon atoms and $R^4$ is an alkyl or alkenyl radical having 8 to 10 carbon atoms and y is a number from 20 to 35 and z is a number from 1 to 3.

11. A washing and cleaning agent comprising the mixture of claim 1.

12. The agent as claimed in claim 11, wherein the mixture is used in the cleaning agent in amounts of from 0.1 to 15% by weight, preferably from 1 to 10% by weight.

13. A method for improving drying performance of a cleaning agent comprising adding to the agent, the mixture.

14. A cleaning agent comprising 0.1 to 15% by weight of a mixture as claimed in claim 1, and further nonionic, anionic and/or cationic surfactants, and also optionally builders, enzymes, rinse aids and/or further auxiliaries and additives.

15. A method for improving drying performance of a cleaning agent comprising adding to the agent the mixture according to claim 1.

16. The mixture as claimed in claim 2, wherein, in the formula (Ia), R, R' and R" are in each case a linear, saturated alkyl radical, where R is an alkyl radical having 8 to 16, R' and R", independently of one another, are an alkyl radical having 10 to 16 carbon atoms and n and m, independently of one another, assume a value from 20 to 30.

17. The mixture as claimed in claim 16, wherein, in the formula (Ib), the radicals R'" and R"", independently of one another, are saturated alkyl radical having 4 to 14 carbon atoms, and the indices n and m, independently of one another, assume values from 1 to 15 and in particular from 1 to 12.

* * * * *